United States Patent [19]

Pettersson

[11] 4,260,344

[45] Apr. 7, 1981

[54] ARRANGEMENT FOR GUIDING CASTING FORMS

[76] Inventor: John P. Pettersson, Pl. 1130, 76015 Gräddö, Sweden

[21] Appl. No.: 117,762

[22] Filed: Feb. 1, 1980

[30] Foreign Application Priority Data

Feb. 5, 1979 [SE] Sweden ..... 7901006

[51] Int. Cl.[3] ..... E04G 11/22; E04G 11/24

[52] U.S. Cl. ..... 425/63; 244/20; 425/65

[58] Field of Search ..... 425/60, 62, 63, 64, 425/65; 249/10, 11, 12, 13, 14, 15, 16, 17, 18, 19, 20, 21, 22

[56] References Cited

U.S. PATENT DOCUMENTS

| | | | |
|---|---|---|---|
| 1,784,422 | 12/1930 | Fabre | 425/65 |
| 2,492,502 | 12/1949 | Salmon | 425/65 X |
| 3,252,199 | 5/1966 | Bössner | 425/65 |
| 3,399,438 | 9/1968 | Rohlf | 249/17 X |
| 3,497,579 | 2/1970 | Barron | 425/63 X |
| 3,632,079 | 1/1972 | Rohlf | 249/17 X |
| 4,128,610 | 12/1978 | Ahlgren | 425/63 X |

*Primary Examiner*—J. Howard Flint, Jr.

*Attorney, Agent, or Firm*—Silverman, Cass & Singer, Ltd.

[57] ABSTRACT

An arrangement for guiding casting forms, which comprise a so-called working plane (1) in the form of, for example, a beam system, which is capable to support two casting form halves (3,4), between which concrete is intended to be poured. The casting forms further comprise a yoke (11) supported on legs (12), which yoke has the design of, for example, a frame with two preferably mutually parallel, substantially vertical sides (12) and one side (11) located intermediate and perpendicularly to said sides. The yoke (11) preferably is located above the working plane (1) and rigidly connected to the working plane (1).

According to the invention at least two guide bridles (14,23) in the form of, for example, strip iron, and a friction device (17) are provided. The guide bridles (14) are intended to be rigidly anchored at one end (15) preferably in a ground level plane (16). The guide bridles are extendible and with maintained tension therein to be attached by said friction device (17) also to the yoke (11) connected to the working plane (1), in order to stay a casting form in a vertical plane or in a plane forming an angle with the vertical plane.

4 Claims, 4 Drawing Figures

ARRANGEMENT FOR GUIDING CASTING FORMS

This invention relates to an arrangement for guiding casting forms.

Concrete walls often are cast by using either a so-called climbform or a slipform. A climbform substantially comprises two walls in parallel with each other, so-called form halves, between which concrete is poured. The form halves according to certain embodiments are supported by a structure, which carries both halves and most often is supported by struts against the ground or a cast concrete floor. Cranes are used for lifting such a climbform.

Differently from a climbform, a slipform is caused to successively slide upward while concrete is poured substantially continuously or at uniform time intervals.

With climbforms as well as slipforms it is difficult to obtain walls having all along their height the same inclination relative to the horizontal plane. The inclination in most cases is 90°, i.e. vertical walls are desired. Even when a wall has become vertical near the ground level, problems arise when so guiding the forms that the vertical direction is maintained while casting a wall of successively increasing height.

For this reason, extensive staying and reinforcing structures are required in many cases. Climbforms, for example, mostly are stayed both from the ground and from a lower wall portion already cast and solidified.

As deviations from and incorrectnesses of the desired alignment in this connection mostly are added along a wall in vertical direction, the said structures must meet high requirements and involve substantial costs.

The present invention relates to a simple and cheap arrangement for guiding casting forms, which arrangement also permits high precision.

The present invention, thus, relates to an arrangement for guiding casting forms, which comprise a so-called working plane in the form of, for example, a beam system capable to support two form halves, between which concrete is to be poured, and which further comprise a yoke in the form of, for example, a frame having two mutually parallel, substantially vertical sides and an intermediate side perpendicular thereto, which yoke is located preferably above the working plane and rigidly connected to the working plane or to some detail or details rigidly connected thereto.

The invention is characterized in that at least two guide bridles in the form of, for example, strip irons, and a friction device are provided, which guide bridles are intended to be anchored firmly with one end in a ground level plane and capable to extendibly and with maintained tension in the guide bridles be attached by means of said friction device to the yoke connected to said working plane, in order to stay a casting form in a vertical plane or in a plane forming an angle with the vertical plane.

Figure 1:
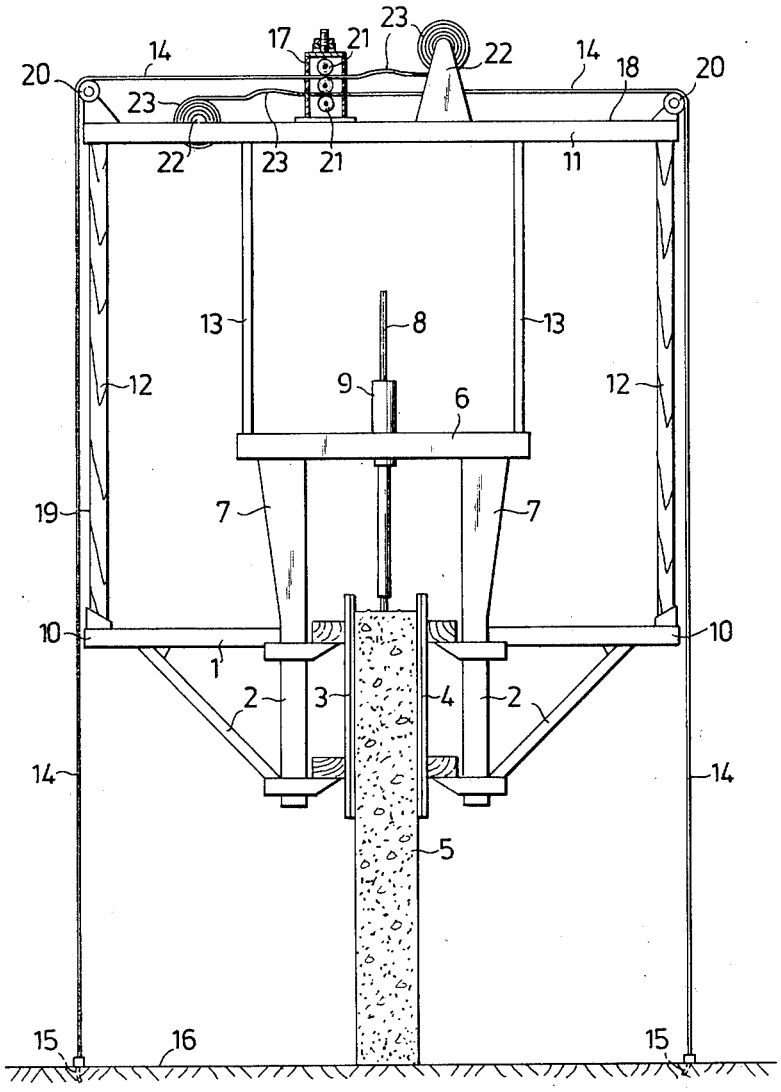
Figure 2:
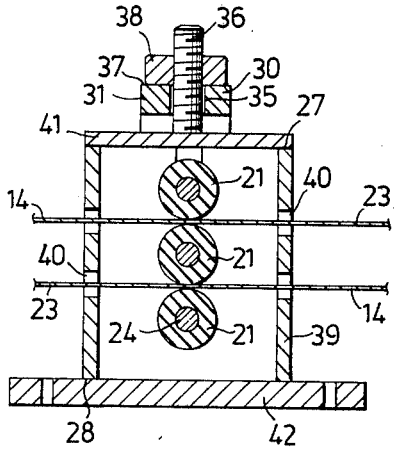
Figure 3:
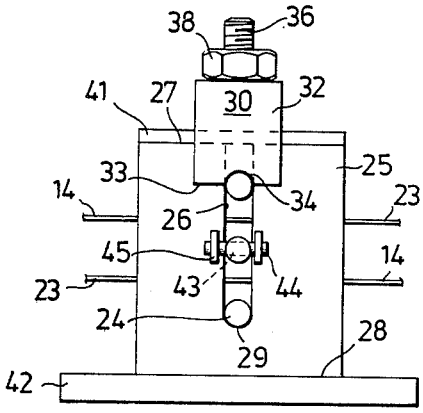
Figure 4:
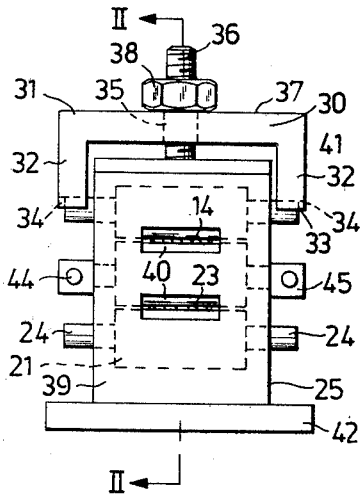

The invention is described in greater detail in the following, with reference to the accompanying drawings, in which FIG. 1 is a sectional view of an arrangement according to the invention with a schematically shown friction device, and of a casting form, FIG. 2 is a section according to FIG. 4 through a friction device according to the invention, FIG. 3 is a view from the right in FIG. 4 of a friction device, FIG. 4 is a view of a friction device according to the invention seen in the direction, in which loaded guide bridles run through the same, i.e. seen from the left in FIG. 1.

In FIG. 1 a slipform is shown with the present invention applied thereto. The slipform comprises a so-called working plane 1, which is capable by means of stay members 2 to support casting form halves 3,4, between concrete is to be poured. 5 designates a wall portion already cast.

In connection to the working plane 1 and the system of stay members 2, a slipform yoke 6 is provided, which is supported on two yoke legs 7, which are located each in connection to a casting form half 3,4 and project upward above the working plane. The yoke legs 7 are substantially vertical, and the slipform yoke 6 is substantially horizontal when a vertical wall 5 is being cast.

It is assumed in this description that a vertical wall is to be cast and, therefore, several details are described as being vertical or horizontal. When a wall forming a certain angle with a vertical plane is to be cast, said details in applicable cases will assume a corresponding inclination.

A vertical climb tube 8 is inserted downward into the wall 5 already cast and is intended also to project upward through the slipform yoke 6. In connection to the slipform yoke 6, a jack 9 or the like is intended to serve as a lifting means for the slipform by means of the climb tube 8 with which the jack 9 co-operates.

A yoke 11 is connected by means of two yoke legs 12 to the working plane 1, preferably to the two outer edges 10 thereof. Said yoke legs 12 are so located at said outer edges 10 that there is one yoke leg at each outer edge. The yoke arrangement 11,12 preferably has the configuration of a frame, in which the yoke legs 12 each constitute one side. The legs are mutually parallel and substantially vertical. The yoke 11 is an intermediate, substantially horizontal side of the frame and perpendicular to said sides.

The yoke 11 preferably is located above the working plane and is supported preferably also, for example, by vertical strut members 13 extending between the slipform yoke 6 and the yoke 11. The length of the yoke 6 is shorter than that of the yoke 11, as can be seen in FIG. 1.

In FIG. 1 the numeral 14 designates guide bridles, which should be at least two and consist, for example, of strip irons. Said guide bridles 14 are intended to be anchored in a suitable way at one end 15 preferably in a ground level 16. The guide bridles 14 further are extendible and intended with maintained tension therein to be attached by means of a friction device 17 preferably to the upper surface 18 of the yoke 11 connected to the working plane 1, in order to stay the casting form in a vertical plane or in a plane forming an angle with the vertical plane. As shown in FIG. 1, for example two guide bridles 14 are arranged to run from the ground level 16 substantially vertically on the outside 19 each of a yoke leg 12 and via pulley wheels 20 horizontally along the upper surface 18 of the yoke 11 to the friction device 17.

The said guide bridles 14 are intended to be clamped, held and maintained stretched by friction between friction members in the form of rolls 21 and the guide bridles 14. Said friction members are comprised in the friction device 17, which in FIG. 1 is shown very schematically and in greater detail in FIGS. 2–4.

It was assumed in this description that the friction device is designed with the rolls arranged in a vertical plane as in FIG. 1 and with the longitudinal direction of the rolls being horizontal. Several details of the friction device, therefore, are described as being vertical or horizontal. The device 17, of course, can be arranged in different ways without jeopardizing its function. The longitudinal direction of the rolls, for example, may be vertical.

The guide bridles 14 and the friction device 17 are arranged so, that even at an elongation of the loaded portion 14 of the guide bridles the guide bridles are clamped between said friction members 21. Such an elongation is necessary when the slipform is lifted for casting a new wall portion on a higher level than the wall portion 5.

Guide bridle supplies 22 in the form of, for example, coiling reels for strip iron are provided preferably in close connection to the friction device 17 and intended to contain unused, i.e. unloaded, part 23 of each guide bridle and upon elongation of the loaded part 14 of the guide bridles to supply the necessary guide bridle amount.

As already mentioned, the guide bridles 14 are intended to be attached to the yoke 11 by means of the friction device 17. Said device comprises three substantially cylindric rolls 21, which on their outer surface are coated with elastic friction material, for example rubber, and the axial directions of which are substantially in parallel with each other. Said rolls 21 are arranged in a vertical plane, preferably not offset relative to each other in axial direction, and rotatable about their respective longitudinal axis. The guide bridles 14 are intended to be inserted between the upper one and the central one of said rolls 21 and between the lower one and the central one thereof.

The rolls 21 are provided with journals 24 at each end and by means of these journals mounted in and between two end walls 25, which are substantially vertical, parallel in relation to each other and perpendicular to the longitudinal direction of the rolls 21. Each end wall comprises a substantially vertical through groove 26, the width of which exceeds slightly the diameter of said journals, and which extends from the upper edge 27 of the end wall 25 where the groove is open, to slightly above the lower edge 28 of the end wall 25 where the end 29 of the groove 26 preferably has semicircular shape, as shown in FIG. 3. The journals 24 of the rolls 21 are intended to be inserted and supported in said groove 26. The numeral 30 designates a yoke, which comprises a horizontal portion 31 in parallel with the longitudinal direction of the rolls 21, and two vertical portions 32, which in their lower edge 33 are provided with a groove 34, in which a journal 24 of the upper roll is intended to abut. The yoke 30 is intended to transfer a force to the package of three rolls 21, so that these rolls are loaded radially. The said force is intended to be produced by means of a screw 36, which is rigidly connected to the end walls 25 and projecting upward through a vertical through hole 35 in the horizontal portion 31 of said yoke 30, and of a nut 38 abutting the upper surface 37 of the horizontal portion 31.

As appears from FIGS. 2–4, the friction device further comprises two additional end walls 39 with openings 40 for the guide bridles 14,23, an upper surface 41 and a bottom plate 42.

The central roll 21 is lockable against rotation about its longitudinal axis, for example by means of holes 43 through the journals 24 and bolts 44, which are intended to be inserted through eyes 45 attached to the end walls 25, and through holes 43 as shown in FIG. 3. For releasing the locking, the bolts 44 are removed.

The arrangement according to the invention has the function as follows. The casting form is directed so that the desired inclination is obtained, for example so that a vertical wall will be cast. The form halves 3,4 then are vertical, and the working plane is substantially horizontal.

The guide bridles 14 are stretched and clamped between the rolls 21 in the friction device 17 by means of the yoke 30. The central roll is locked against rotation about its longitudinal axis by the locking means 24,43,44,45. The casting form now cannot tilt to form an angle with the vertical plane, because tilting is counteracted by guide bridles irrespective of in which direction the form tends to tilt. The length of the loaded part 14 of the guide bridles 14 is held constant by friction between the central roll locked against rotation, the other rolls and guide bridles.

When the form is to be lifted, the locking means 24,43,44,45 is released. The load exercised by the yoke 30, however, substantially is maintained. Thereby slip between rolls and guide bridles 14 is prevented, because at the lifting the rolls 21 are turned while the loaded part 14 of the guide bridles is elongated as additional guide bridle length is received from the supply 22. As the elongation of the two bridles is controlled by non-slip unwinding along the periphery of the same roll, i.e. the central one, both guide bridles 14 necessarily are elongated equally. The direction of the casting form, which direction can be said to depend on the length of the loaded part of the guide bridles 14, thus is maintained even during and after the lifting operation, because the guide bridles 14 are elongated equally much. When vertical direction was set, thus, this is maintained, and when a direction was set at which the casting form forms a certain angle against a vertical plane, this direction is maintained.

A set direction also can be changed while the casting is going on, in that the friction device is moved to the right or left in FIG. 1 and thereby the casting form is forced to tilt, without the loaded part 14 of each guide bridle being permitted to be changed.

It is obvious that several different embodiments of an arrangement according to the invention can be imagined without abandoning the idea of the invention.

The frame comprising the yoke 11 and yoke legs 12, for example, can be designed in several different ways.

Furthermore, a great number of embodiments of the friction device 17 are imaginable, at which, for example, the load on the rolls is brought about in a way other than by jack or the like. The location and orientation, too, of the friction device can be varied, for example by turning the device, compared with the embodiment described here, so that the longitudinal direction of the rolls 21 lies in a vertical or substantially vertical plane.

The present invention, thus, must not be regarded restricted to the embodiment described above, but can be varied within the scope defined by the attached claims.

I claim:

1. An arrangement for guiding casting forms, which comprise a working plane in the form of a beam system capable to support two casting form halves, between which concrete is intended to be poured, and which further comprise a yoke, in the form of, for example, a frame with two substantially vertical, mutually parallel sides and an intermediate side perpendicular to said sides, which yoke is located preferably above the working plane and rigidly connected to the working plane or to some detail(s) rigidly connected thereto, characterized in that at least two guide bridles (14,23) in the form of, for example, strip irons and a friction device (17) are provided, which guide bridles (14) are intended to be rigidly anchored at one end preferably in a ground level plane (16) and to be attached extendibly and with maintained tension therein by said friction device (17) also to the yoke (11) connected to said working plane (1), in order to stay a casting form in a vertical plane or in a plane forming an angle with the vertical plane.

2. An arrangement as defined in claim 1, characterized in that said guide bridles (14) are capable to be clamped, held and maintained stretched by friction between friction members (21) associated with the friction device (17) and the guide bridles (14), that the guide bridles (14) and the friction device (17) are arranged so, that even at elongation of the loaded part (14) of the guide bridles the guide bridles (14) are clamped between said friction members (21), and that guide bridle supply means (22), for example coiling reels for strip iron, are provided and intended to contain unused, i.e. unloaded part (23) of each guide bridle (14,23), which supply means are capable upon elongation of the loaded part (14) of the guide bridles to provide necessary guide bridle length.

3. An arrangement as defined in claim 1 or 2, characterized in that said guide bridles (14) are intended to be attached to said yoke (11) by means of said friction device (17), which comprises three cylindric rolls (21), which on their outer surface are coated with elastic friction material, for example rubber, and the axial directions of which are substantially parallel relative to each other, which rolls (21) are arranged in one plane and not offset relative to each other in axial direction, and rotatable about their respective longitudinal axis, and which guide bridles (14) are intended to be inserted between one of the outermost ones and the central one of said rolls (21) as well as between the other one of the outermost ones and the central one thereof, that the central one of said rolls (21) is lockable against rotation about its longitudinal axis, and that means (31,32,36,38) are provided, by which said rolls (21) are intended to be loaded substantially radially, so that the rolls lying outermost are pressed against the central roll (21) locked against rotation, whereby guide bridles (14) between the rolls (21) are clamped and, thus, held in the friction device (17).

4. An arrangement as defined in claim 3, characterized in that said rolls (21) are provided with a journal (24) at each end and by means of the same mounted in and between two end walls (25), which are substantially mutually parallel and perpendicular to the longitudinal direction of the rolls (21), and each of which comprises a through groove (26), the width of which slightly exceeds the diameter of said journals (24), and which groove (26) extends from one end wall edge (27) where the groove is open to slightly inside of the other end wall edge (28), where the end (29) of the groove preferably has semicircular shape, and in which grooves (26) said journals (24) are intended to be inserted, that said rolls (21) are intended to substantially radially be loaded by a yoke (30), which comprises one portion (31) in parallel with the longitudinal direction of the rolls (21) and two portions (32), which at their free edge (33) are provided with a groove (34), in which a journal (24) of the one of the outermost rolls which is located closest to the open end of the goove (26) in each end wall (25) is intended to abut, and that said load is intended to be brought about by means of a screw (36) or the like, which is rigidly connected to said end walls (25) and projects out through a through hole (35) in said yoke portion (31) in parallel with the longitudinal direction of the rolls (21), and by a nut (38) or the like abutting the side (37) of said portion (31) located farthest away from the rolls (21).

* * * * *